US006461221B1

(12) United States Patent
Stilwell et al.

(10) Patent No.: US 6,461,221 B1
(45) Date of Patent: Oct. 8, 2002

(54) INFLATABLE SUPPORTS FOR GARMENTS

(75) Inventors: Fred W. Stilwell, Merrill, OR (US); Denise R. Stilwell, El Segundo; Tricia M. Olsen, Hermosa Beach, both of CA (US)

(73) Assignee: Myhaertbra, Inc., El Segundo, CA (US)

( * ) Notice: Subject to any disclaimer, the term of this patent is extended or adjusted under 35 U.S.C. 154(b) by 0 days.

(21) Appl. No.: 09/724,763

(22) Filed: Nov. 28, 2000

(51) Int. Cl.[7] ..... A41C 3/00
(52) U.S. Cl. ..... 450/57; 450/38
(58) Field of Search ..... 450/38, 57; 2/267, 2/268

(56) References Cited

U.S. PATENT DOCUMENTS 76,894 A * 4/1868 Cook ..... 450/38
3,326,218 A * 6/1967 Mc Alpine ..... 450/38
5,347,656 A * 9/1994 Fabritz et al. ..... 450/38
5,833,515 A * 11/1998 Shahbazian et al. ..... 450/38
6,080,037 A * 6/2000 Lee et al. ..... 450/38

* cited by examiner

*Primary Examiner*—Gloria Hale
(74) *Attorney, Agent, or Firm*—Klarquist Sparkman LLP

(57) ABSTRACT

A garment for enhancing the natural shape and size of a wearer's breasts includes left and right breast supporting cups with inflatable portions designed to direct the inflation inwardly toward a wearer's breasts while restricting expansion of the inflatable portions in an outward direction. Desirably, the inflatable portions are positioned to exert force primarily inwardly and upwardly against a lower portion of the wearer's breasts.

33 Claims, 3 Drawing Sheets

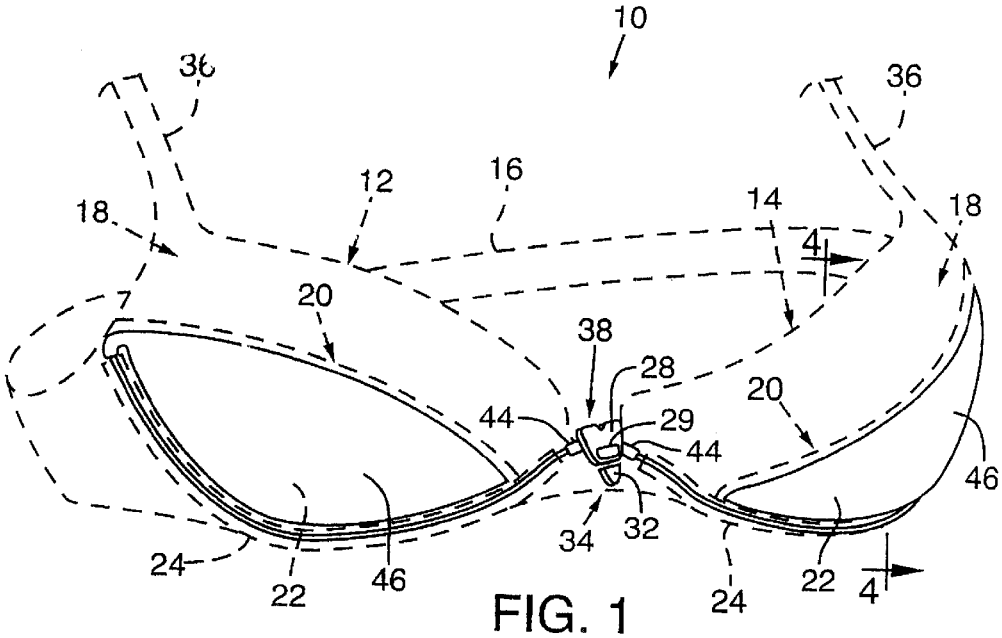
FIG. 1
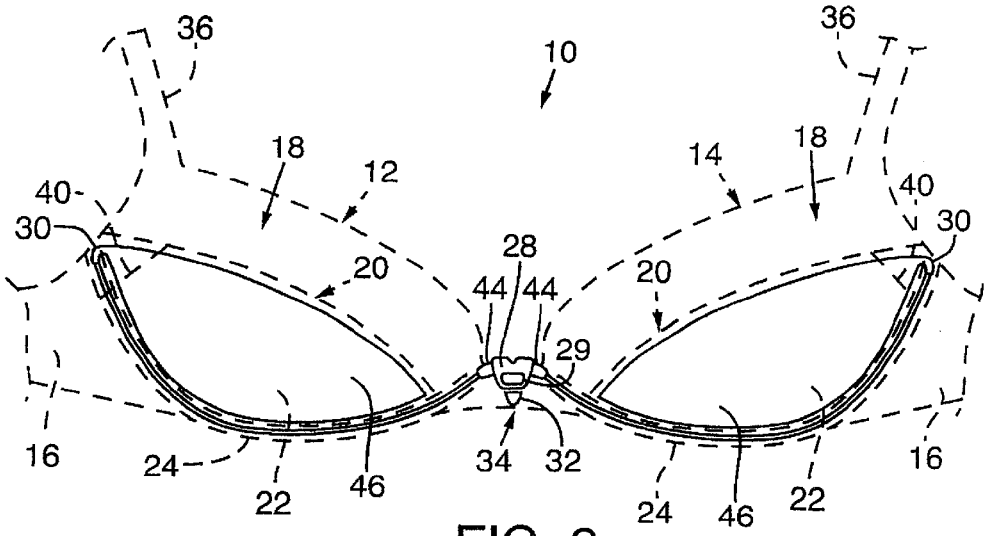
FIG. 2
FIG. 3
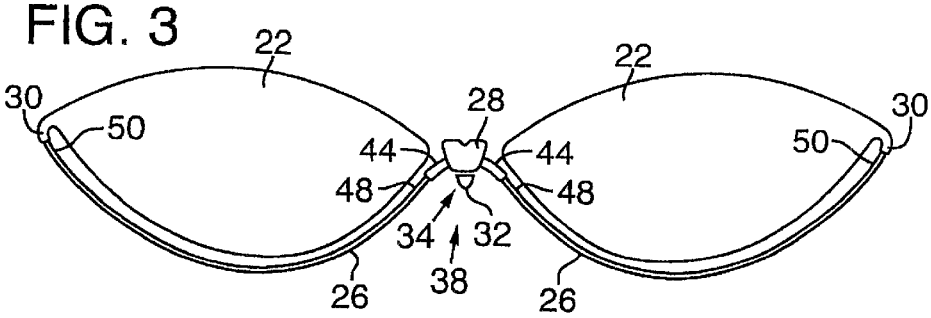

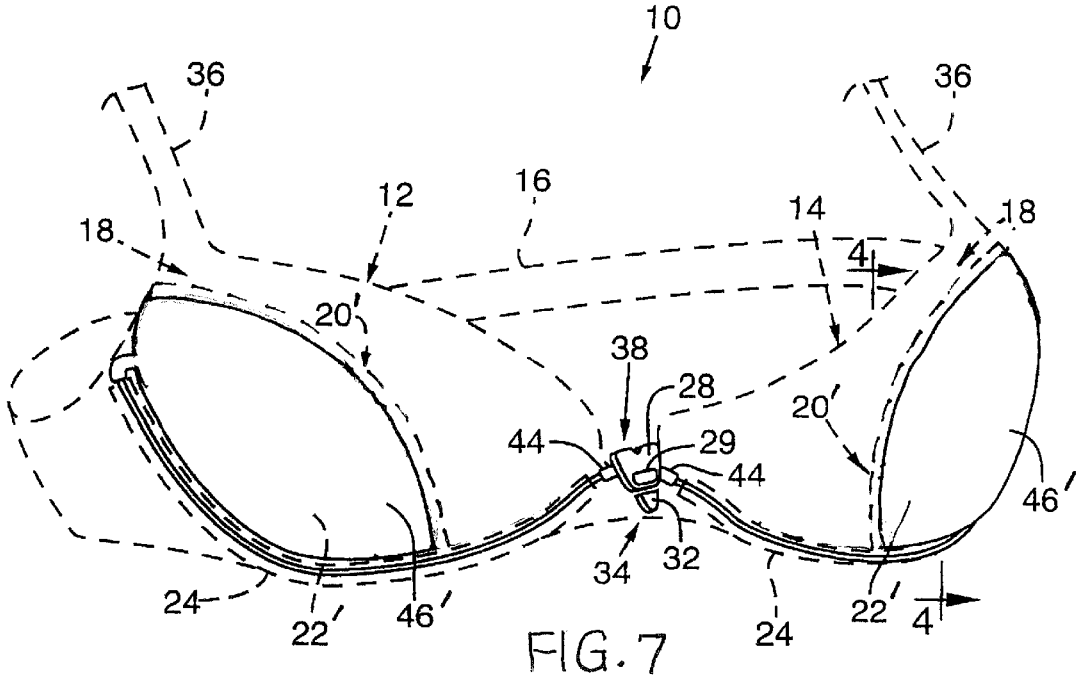
FIG. 7
FIG. 8
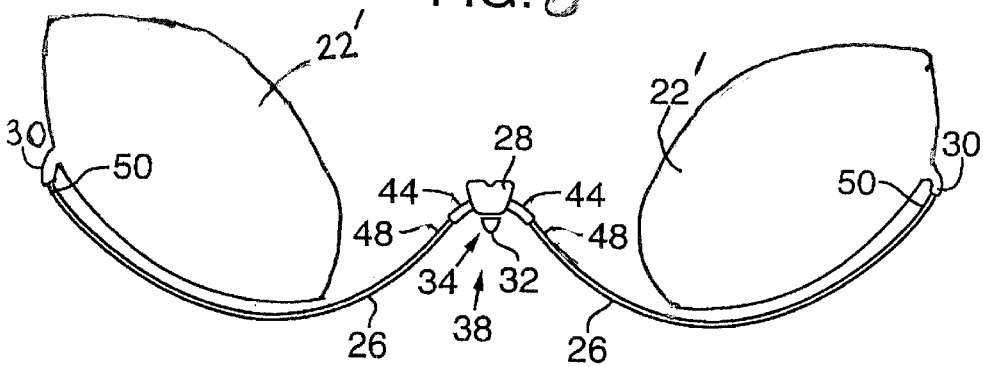

INFLATABLE SUPPORTS FOR GARMENTS

FIELD OF INVENTION

This invention relates generally to garments and more particularly to garments, such as brassieres and swimsuits, having inflatable supports for enhancing the natural shape of a wearer's breasts and also to the supports themselves.

BACKGROUND OF INVENTION

Breast augmentation or shaping devices for use in garments such as brassieres and swimsuits have been used for years to enhance the natural shape and supplement the apparent size of the wearer's breasts. Conventional breast augmentation devices typically include a pair of breast pads, usually made of foam rubber, which are inserted or sewn into the breast cups of a garment. Other breast enhancing devices attempt to simulate the consistency and feel of real breast tissue such as by utilizing breast pads made of gel-filled pliable pouches.

Existing breast pads, however, are often undesirable in that they typically come in a size which is standard for the garment. Thus, the breast pads may provide too much enhancement for the taste of some wearers and not enough enhancement for the taste of others. Further, breast pads are bulky and difficult to conceal so that their use is somewhat limited in two-piece swimsuits, which do not always provide significant coverage.

To overcome these disadvantages, inflatable bladders have been used in lieu of conventional pads. The bladders are fluidly connected to a pressurized fluid source, such as an on-board air pump, which is operable to inflate the bladders as desired to suit the particular taste of the wearer. One example of such a device is disclosed in U.S. Pat. No. 2,764,759. While inflatable bladders are effective in enlarging the appearance of the breasts of a wearer, they are not known to provide uplifting support to the wearer's breasts. As a result, they are not as effective in creating a pronounced cleavage for wearer. Existing bladders may also be undesirable because they protrude outwardly and stretch the outer layer of the garment surrounding the breasts, thereby increasing the possibility of creating unnatural and unsightly lumps.

Therefore, a need for a new and improved inflatable breast supports, garments with such supports, and related methods for enhancing the apparent size and shape of a wearer's breasts.

SUMMARY

A garment cup is described for supporting a breast of an individual who wears the cup. Typically, two such cups are provided for garments and may be built into a garment such as a brassiere or swimsuit.

In one form, the cup comprises a pocket having first inner and second outer wall portions which together define the pocket. When worn, typically at least a majority of the first inner wall portion is positioned nearer to the breast to be supported than the second outer wall portion. The first inner wall portion comprises at least one section of a greater flexibility than the flexibility of the second outer wall portion. This section of greater flexibility may be substantially co-extensive with the entire first inner wall portion which bounds the pocket. The pocket is expandable when supplied by fluid with the section of the first inner wall of greater flexibility distending to a greater extent than the second outer wall portion to provide support to the breast of the individual. That is, the pocket tends to expand rearwardly toward the breast rather than outwardly where unnatural or unsightly bulges could result. A fluid supplier or pressurized fluid delivery mechanism, which in one form may comprise an air pump, is operable to supply fluid to expand the pocket.

In accordance with one embodiment, an inflatable bladder may be disposed within the pocket and may be fluidly coupled to the fluid supplier. The bladder expands when supplied with fluid to thereby expand the pocket. The pocket may include a slot through which the bladder is accessible for removal from the pocket, such as during cleaning of the garment and/or for repair purposes. The pocket may be positioned to extend only along a lower portion of the cup such that when inflated a rearward and upward force is exerted against the supported breast.

The fluid supplier may be a source of liquid, a valve through which air is blown, for example by the wearer of the garment, or any other fluid supply mechanism. In one desirable form, the fluid supplier comprises at least one air pump fluidly coupled to respective bladders located in pockets at the right and left side of the garment with air supply lines being flexible tubes extending along the underside of the cups. The air lines may extend only along the underside of one or both cups and may be positioned in sleeves or passageways positioned at such locations.

The first inner wall may be comprised of at least one fabric layer comprised of a first material and the second outer wall may be comprised of at least one fabric layer comprised of a second material. These materials may be varied. In addition, the inner wall is desirably less stiff than the outer wall. In the event a garment is provided with two such cups, the respective outer walls may, but not necessarily are, of the same stiffness while the respective inner walls are less stiff. The inner walls are desirably of the same stiffness, but this is not necessary. For example, one breast of an individual may require greater support than the other breast. One way to accomplish this is to provide inner walls of differing flexibilities or stiffness. At least one relief valve, which may be incorporated into the pump, is desirably provided for selectively deflating the bladders included in the garment to thereby adjust the amount of support that is provided. The left and right bladders included in the garment may be selectively and independently inflatable and deflatable to adjust their respective sizes. For example, separate valves may be provided for controlling the amount of air or fluid retained in each of the bladders. However, more desirably is the provision of only a single air pump for the system with the pump being centrally located, such as between the breasts of the user when the garment is worn. Air supply lines may be positioned to communicate from the pump to the respective bladders at bladder fluid supply locations. The bladder fluid supply locations may be spaced from the pump and desirably are located at the respective sides of the bladders furthest away from the pump. The supply lines may extend from the pump and underneath the breasts to the bladder supply locations and thus provide added support along the undersurface of the wearer's breasts. By positioning the pump at this intermediate location, the pump does not produce unwanted bulges in the garment when the structure of this embodiment is incorporated into the garment.

The pump structure itself and location of fluid supply lines is also believed to be unique apart from designing the structure to direct expansion of an inflatable portion thereof primarily inwardly toward the breast of the wearer as opposed to outwardly. Although not required, the bladder itself may be formed of material which directs expansion of the bladder toward the supported breast with or without any pocket structure.

In a method in accordance with one aspect of an embodiment, an inflatable bladder is positioned in a garment so as to apply a rearward and upward force against the supported breast of the garment wearer when the bladder is inflated. In addition, the freedom of the bladder to expand in a forward direction is restricted relative to the freedom of the bladder to expand in a rearward direction against the wearer's breasts. Consequently, when the bladder is inflated, the possibility of unsightly bulges being formed at the front of the garment is minimized. In addition, in accordance with this method, the bladder may be positioned along a lower portion of a supported breast such that inflating the bladder urges the breast upwardly to thereby augment its shape.

The present invention is directed toward new and unobvious features of a garment cup and of garments including breast supporting mechanisms alone as well as in combination with one another, as well as toward novel and unobvious aspects of breast supporting methods as described herein.

BRIEF DESCRIPTION OF THE DRAWINGS

FIG. 1 is a front perspective view of a garment with breast supporting cups in accordance with one embodiment of the present invention.

FIG. 2 is a back perspective view of the garment and cups.

FIG. 3 is a front view of one form of inflatable bladders and pump usable in the garment of FIG. 1.

FIG. 7 is a front perspective view of a garment with breast supporting cups of another embodiment.

FIG. 8 is a front view of the inflatable bladders and pump usable in the garment of FIG. 1.

DETAILED DESCRIPTION

Figure 4:
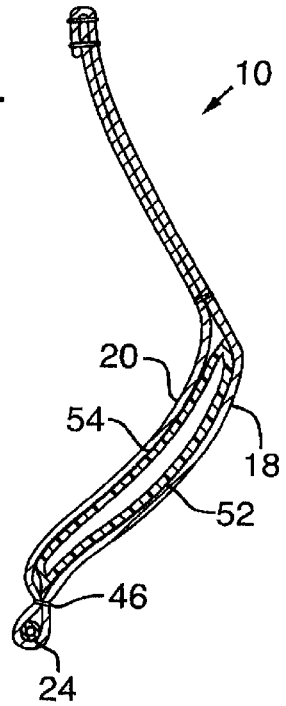
FIG. 4 is a vertical sectional view of the garment of FIG. 1, taken along line 4—4 of FIG. 1, with a bladder in a substantially non-inflated state

Referring first to FIGS. 1 and 2, a garment 10, such as a brassiere or swimsuit top is shown in accordance with one embodiment of the present invention. The garment may be of any other type. The garment 10 includes right and left breast supporting cups 12, 14 which are secured at the front with a connecting portion 34. The outer edges of cups 12, 14 are connected to a longitudinally extending torso strap 16 which is adapted to stretch or fit around the back of a wearer. Alternatively, the torso strap 16 may be made from two separate pieces which are secured to the outer edges of the cups and interconnected at the back of the wearer by tying a knot or by a fastening mechanism, such as a conventional hook or snap assembly. The illustrated garment 10 is supported on the wearer with a pair of optional shoulder straps 36, each of which may extend from one of the cups 12, 14 to the torso strap 16 or, alternatively, be tied behind the wearer's neck.

As best shown in FIG. 2, each of the illustrated cups 12, 14 is constructed of at least one outer layer 18 formed in the shape of a cup and at least one inner layer 20 shaped to overlie, in this case, at least the lower portion of the cup. The inner layer 20 is stitched or otherwise secured to the outer layer 18 to define a pair of expandable chambers or pockets 46 which extend across the lower portion of the cups 12, 14 to provide support for the undersides of the wearer's breasts. For example, the pockets may be positioned at or below the midline of the cup and/or with a majority of the pocket positioned below the cup midline. The pockets 46 are fluidly connected to a pressurized fluid source to inflate the pockets 46 as desired by the wearer. It is desirable that the outer layers 18 exhibit a greater amount of rigidity than the inner layers 20 so that the inner layers 20 distend substantially more than the outer layers 18 upon inflation of the pockets 46. As a result, the cups 12, 14 of the garment 10 will maintain their cuplike shape when the bladders 22 are pressurized. To accomplish this, the outer and inner layers may be comprised of different materials. Alternatively, the outer layers 18 may be made of a material that is thicker than that of the inner layers. Although variable, in one specific example, the outer layers 18 are made of satin or nylon and the inner layers 20 are made of spandex. The inner wall or section, in this example, is about one-third as stiff or three times more flexible than the outer wall.

As another alternative, the inner layers may comprise at least a section of greater flexibility than the outer layers so as to direct expansion of the bladders inwardly and upwardly against the wearer's breasts as explained below. As yet another alternative, the bladders may be constructed with inner and outer walls of different materials, or of different thickness (e.g., the inner wall being thinner) to direct expansion of the bladders in the desired direction.

It should be appreciated that the invention is equally applicable to various other types of garments including strapless and front opening bras. The invention is also applicable to garments other than brassieres, such as one and two-piece swimsuits, dresses and blouses.

As shown more clearly in FIG. 3, a fluid supplier such as the pressurized fluid source of the illustrated embodiment may desirably comprise an air inflation assembly 38 having a pair of inflatable bladders 22. The bladders 22 are positioned in the pockets 46 (as shown in FIGS. 1 and 2) or otherwise secured to the garment and fluidly connected to, in this example, a manually actuated air pump 28. As shown in FIG. 2, slots 40 are desirably defined in the inner layers 20 adjacent the outer edges of the cups 12, 14 to permit insertion of the bladders 22 into the pockets 46. If necessary, the bladders 22 may also optionally be removed from the pockets 46 by pulling the bladders through the slots 40.

The air pump 28 is operable to inflate the bladders 22 with pressurized air so that inflation of the bladders 22 causes the pockets 46 to inflate. Again and alternatively, the bladders 22 may be pressurized by other means, such as by a detachable pump or by blowing into a mouthpiece that is in fluid communication with the bladders. It should also be appreciated that, although less desirable, liquids or other fluids other than air may be utilized to pressurize the bladders 22. Further details of the construction and operation of the illustrated inflation assembly 38 are described below.

The bladders 22 of the air inflation assembly 38 may be, although not necessarily the case, identically shaped and sized. The bladders may be independently supplied with fluid, such as through respective valves or from separate sources. Consequently, the bladder sizes may be adjusted differently if one breast requires more augmentation (e.g., due to a change in breast shape as a result of surgery) than the other. However, typically the bladders are in fluid communication with each other and with a single pump. Each bladder 22 is constructed of a front portion 52 that is in contact with the outer layer 18 of the garment 10 and a back portion 54 that is in contact with or adjacent to the inner layer 20 of the garment 10. To further ensure that the cups 12, 14 retain their original cup-like shape upon inflation of the bladders 22, the front portions 52 of the bladders 22 may exhibit greater rigidity than their back portions 54. This may be accomplished by making the bladder front and rear portions of different materials or of different thicknesses. Alternatively, the front portions 52 and back portions 54, respectively, may be made of the same material. As a specific example, dipped neoprene may be used. As a more specific example, 3120-88 synthetic latex from Diversified Compounders of Los Angeles, Calif. may be used. To minimize possible allergic reactions to latex, other non-latex materials may be used.

The air pump 28, which may be centrally mounted on the connecting portion 34 of the garment 10, such as by a fastener, an adhesive, stitching in place, or other suitable means. The air pump is fluidly connected to the bladders 22 via air supply lines, such as flexible air supply tubes 26. Tubes 26 may, for example, be comprised of tubes of polyethylene, having an outside diameter of 0.125 inch. The materials and instruction of the air supply lines may be varied. To inflate the bladders 22, the pump 28 may have a pump bladder 29 which is depressed to force air from the pumping chamber of the pump 28 through the air supply tubes 26 and into the bladders. The pump 28 may be outwardly biased so that when the pump bladder 29 is released, it will spring back to its relaxed position, thereby drawing air into a pumping chamber of the pump. Thus, the pump bladder 29 may be repeatedly depressed until the bladders 22 are inflated as desired to suit the particular taste of the wearer. As one example and though variable, a suitable fully inflated pressure is 2 psi. The pump 28 preferably includes an air relief valve 32 coupled to each of the air supply lines, such as a ball valve, so that the bladders 22 may be deflated by depressing the relief valve 32, which allows the pressurized air in the bladders to vent or escape to atmosphere. In addition, a one-way valve, such as a ball valve, may be included in each of the air supply lines to prevent the back flow of air from the respective bladders and through the pump. The pump may have a pump chamber with a pump chamber opening to the atmosphere. To pump up the bladders, a user closes the pump chamber opening with a thumb or finger and squeezes the pump chamber to force air from the pump chamber and into the bladders. The pump chamber opening is re-exposed to permit the pump chamber to refill with air and then covered again during the next pumping stroke. Although variable, an exemplary pump is generally heart-shaped with a width of about 3.5 cm, a height of about 3.5 cm and a depth of about 1.5 cm. The interior volume of the pump chamber in this example is about 13.8 cubic cm. To pump the bladders to an appropriate level of inflation (e.g., in one example, 172 cubic centimeters total), about twenty-one pump strokes is required. At about 2.5 seconds per stroke in this example, it takes about 8.5 seconds to fill the bladders.

The supply tubes 26, which may be made of any suitable material such as plastic, extend through passageways, which may comprise sleeves 24 formed by the inner and outer layers 18 of the cups 12, 14 (see FIG. 4). Each tube sleeve 24 in the illustrated example, extends only along the underside of the cup from one side of the connecting portion 34 to a location on the outer edge of the cup adjacent the top edge of the torso strap 16. The supply tubes 26 have first ends 48 connected to pump outlet fittings 44 on each side of the pump 28 and second ends 50 connected to bladder inlet fittings 30 disposed adjacent to the outer ends of the tube sleeves 24. The first and second ends 48, 50 are inserted into fittings 44 and 30, respectively, so as to, in this example, form a locking "snap fit" connection that is sufficiently airtight but easily disconnectable. Accordingly, the inflation assembly 38 may be disassembled for removing the supply tubes 26 and bladders 22 from their respective tube sleeves 24 and pockets 46.

Figure 5:
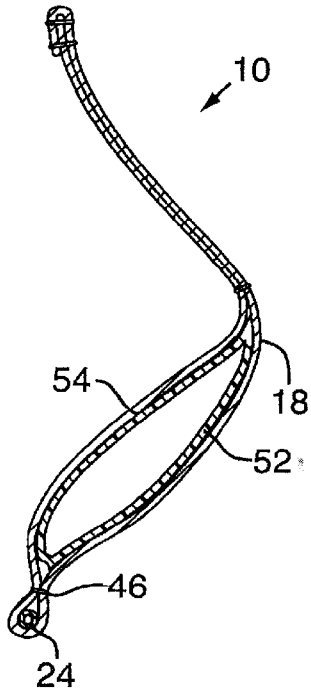
FIG. 5 is a vertical sectional view like that of FIG. 4 with the bladder in a partially inflated state.
Figure 6:
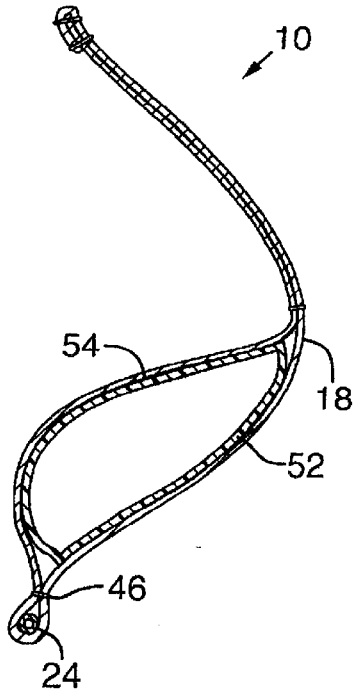
FIG. 6 is a vertical sectional view like that of FIG. 4 with the bladder in a substantially fully inflated state.

Referring to FIG. 4–6, a garment cup 10 is shown with a bladder at various stages of inflation. When the bladder 22 is in a substantially deflated state, as shown in FIG. 4, the garment cup 10 functions as a conventional cup (e.g., a brassiere cup) without any breast enhancing capabilities. When the bladders 22 are inflated, however, the garment cup 10 enhances the natural shape and size of the wearer's breasts. This is accomplished in the following manner. As previously mentioned, in this specific example, the outer layer 18 of the cup and the front portion 52 of the bladder are more rigid than the inner layer 20 of the cup and the back portion 54 of the bladder. As a result, the inner layer 20 and the back portion 54 expand to accommodate the air entering the bladder while the outer layer 18 and the bladder front portion 52 remain relatively unaltered from the non-inflated state (as shown in FIGS. 5 and 6). Thus, the breasts are pushed upwardly and inwardly toward the center of the chest to form the desired fullness and pronounced cleavage to the bustline. Moreover, the rigid outer layer 18 and the front portion 52 maintain the shape of the exterior of the cups 12, 14 upon inflation so that the wearer is provided with the appearance of larger breasts with a natural shape.

FIGS. 7 and 8 show an alternative embodiment in which like elements to those of FIGS. 1 and 3 are given like numbers. A "prime" is used to indicate elements which have a different configuration in FIGS. 7 and 8 from the corresponding elements in FIGS. 1 and 3. In FIGS. 7 and 8, the bladders 22' are still somewhat oval in shape (although other shapes may be used). However, the bladders have been shifted to lie further outward from the center of the user's chest. In this case, a majority of each bladder is positioned outwardly of the user's respective breasts. Consequently, an inwardly and upwardly directed force is applied to the breasts when the bladders are inflated. More specifically, in this example, the lowermost and inwardmost portion of each bladder is positioned slightly inwardly of the center of the supported breast while the outer and upwardmost portion of the bladder is above the center of the supported breast. Pockets 46' and stitching 20' have also been repositioned in this dedsign to accommodate the different bladder position.

The present invention has been described with respect to specific embodiments for illustrative purposes only. The illustrated embodiments may be modified in arrangement and detail without departing from the spirit of our invention. We therefore claim as our invention all such modifications as come within the spirit and scope of the following claims.

I claim:

1. A garment for supporting a breast of an individual wearing the cup, the cup comprising:

a pocket having first inner and second outer wall portions which together define the pocket, at least a majority of the first inner wall portion being nearer to the breast of the individual when the cup is worn than the second outer wall portion, the first inner wall portion comprising at least one section of greater flexibility than the flexibility of the second outer wall portion;

the pocket being expandable when supplied by fluid with the at least one section of the first inner wall portion distending to a greater extent than the second outer wall portion to provide support to the breast of the individual; and a fluid supplier operable to supply fluid to expand the pocket.

2. The garment cup of claim 1 further comprising an inflatable bladder disposed within the pocket and fluidly coupled to the fluid supplier, the bladder expanding when supplied with fluid from the fluid supplier to thereby expand the pocket.

3. The garment cup of claim 2 in which the bladder is removable and in which the pocket includes a slot through which the bladder is accessible for removal from the pocket.

4. The garment cup of claim 1 wherein the pocket extends only along a lower portion of the cup.

5. The garment cup of claim 1 wherein the fluid supplier comprises an air pump and a flexible air supply line extending along an underside of the cup.

6. The garment cup of claim 5 wherein the air supply line extends only along the underside of the cup.

7. The garment cup of claim 1 wherein the first inner wall comprises at least one fabric layer comprised of a first material and wherein the second outer wall comprises at least one fabric layer comprised of a second material.

8. The garment cup of claim 7 wherein the at least one section is co-extensive with substantially the entire first inner wall portion.

9. A garment including two garment cups of claim 1 with the first garment cup being positioned to support the left breast of a wearer of the garment and the second garment cup being positioned to support the right breast of the wearer of the garment.

10. A swimsuit including two garment cups of claim 1 with the first garment cup being positioned to support the left breast of a wearer of the swimsuit and the second garment cup being positioned to support the right breast of the wearer of the swimsuit.

11. A garment comprising:

at least one pressurized fluid source;

a left cup comprising at least one left inner layer and at least one left outer layer, the left inner layer and left outer layer defining a left pocket;

a right cup spaced from the left cup and comprising at least one right inner layer and at least one right outer layer, the right inner layer and right outer layer defining a right pocket;

a left inflatable bladder positioned in the left pocket and a right inflatable bladder positioned in the right pocket, the left and right bladders being fluidly connected to the pressurized fluid source so as to inflate upon receipt of fluid from the pressurized fluid source; and wherein the left and right inner layers each comprise at least a section comprised of a material which exhibits a greater flexibility than the material comprising the left and right outer layers, such that when the left and right bladders inflate, the at least a section of the left and right inner layers distend more than the left and right outer layers to provide support for the respective left and right breasts of an individual wearing the garment.

12. The garment of claim 11 wherein the pressurized fluid source comprises at least one air pump for providing pressurized air as the fluid.

13. The garment of claim 12 including at least one relief valve for selectively deflating the left and right bladders.

14. The garment of claim 12 wherein the at least one air pump has a pump bladder and wherein the at least one air pump is actuated by manually compressing the pump bladder to supply pressurized air to the inflatable bladders.

15. The garment of claim 11 wherein the left and right bladders are selectively and independently inflatable and deflatable to adjust the respective sizes of the left and right bladders.

16. The garment of claim 12 including only a single air pump and wherein the pressurized fluid source further comprises left and right air supply lines extending along the undersides of the left and right cups, respectively, to fluidly connect the left and right bladders, respectively, to the air pump.

17. The garment of claim 16 wherein the left and right cups define left and right passageways extending along the undersides of the left and right cups, respectively, the left and right passageways receiving the respective left and right supply lines.

18. The garment of claim 16 wherein the left and right air supply lines comprise flexible tubes and wherein the left and right passageways comprise respective tube receiving sleeves.

19. The garment of claim 16 wherein the left air supply line extends along the lower periphery of the left cup and the right air supply line extends only along the underside of the right cup.

20. The garment of claim 16 wherein the air pump is positioned at a pump location which is intermediate the left and right cups, the left air supply line being fluidly connected to the left bladder at a first location at an opposed side of the left bladder from the pump location, and the right air supply line being fluidly connected to the right bladder at a second location at an opposed side of the right bladder from the pump location.

21. The garment of claim 11 wherein the left and right pockets each define left and right slots, respectively, through which the left and right bladders, respectively, are accessible for insertion and removal.

22. The garment of claim 11 wherein at least a majority of the left and right pockets are respectively positioned at lower portions of the left and right cups.

23. The garment of claim 11 wherein the left and right inner and outer layers are comprised of fabric and wherein the at least a section is substantially co-extensive with the inner layer of which it is comprised.

24. A garment comprising:

at least one pressurized fluid source;

a left cup comprising at least one left inner layer and at least one left outer layer, the left inner layer and left outer layer defining a left pocket;

a right cup spaced from the left cup and comprising at least one right inner layer and at least one right outer layer, the right inner layer and right outer layer defining a right pocket;

a left inflatable bladder positioned in the left pocket and a right inflatable bladder positioned in the right pocket, the left and right bladders being fluidly connected to the pressurized fluid source so as to inflate upon receipt of fluid from the pressurized fluid source, such that when the left and right bladders inflate, support is provided for the respective left and right breasts of an individual wearing the garment;

a single air pump and wherein the pressurized fluid source further comprises left and right air supply lines extending along the lower peripheries of the left and right cups, respectively, to fluidly connect the left and right bladders, respectively, to the air pump.

25. The garment of claim 24 wherein the left and right cups define left and right passageways extending along the lower peripheries of the left and right cups, respectively, the left and right passageways receiving the respective left and right air supply lines.

26. The garment of claim 24 wherein the air pump is positioned at a pump location which is intermediate the left and right cups, the left air supply line being fluidly connected to the left bladder at a first location at an opposed side of the left bladder from the pump location, and the right air supply line being fluidly connected to the right bladder at a second location at an opposed side of the right bladder from the pump location.

27. A garment for supporting and enhancing the breasts of a wearer, comprising:

a left cup for supporting the left breast of the wearer, the left cup comprising a left outer fabric layer comprised of a material of a first stiffness and a left inner fabric layer comprised of a material of a second stiffness which is less than the first stiffness, the left outer fabric layer and left inner fabric layer defining a left pocket at least a majority of which is located along a lower portion of the left cup, a left cup further including a left inflatable bladder disposed within the left pocket, the left bladder being fluidly connected to a left fluid supply line extending along the underside of the left cup;

a right cup for supporting the right breast of the wearer, the right cup comprising a right outer fabric layer comprised of a material of a third stiffness and a right inner fabric layer comprised of a material of a fourth stiffness which is less than the third stiffness, the right outer fabric layer and right inner fabric layer defining a right pocket at least a majority of which is located along a lower portion of the right cup, the right cup further including a right inflatable bladder disposed within the right pocket, the right bladder being fluidly connected to a right fluid supply line extending along the underside of the right cup;

a pump fluidly connected to the left and right fluid supply lines, the pump conveying pressurized fluid through the left and right lines to inflate the bladders in the left and right cups, respectively, so as to distend the left and right inner fabric layers, respectively, rearwardly and upwardly against the left and right breasts, respectively, while the shape of the left and right outer fabric resist distension as a result of the second and fourth stiffness being greater than the first and third stiffness.

28. The garment of claim 27 wherein the first and third stiffness are substantially the same and the second and fourth stiffness are substantially the same.

29. The garment of claim 27 wherein the pump is an air pump, the pump being located intermediate to the left and right cups, and the left and right fluid supply lines comprising air lines respectively extending from the pump along the underside of the left and right cups to the respective left and right bladders.

30. A garment comprising:

left and right breast supporting cups;

the breast supporting cups each comprising respective inflatable portions, at least a majority of the inflatable portions being positioned at a location along the lower portion of the supported breast; the inflatable portions being operable to inflate primarily in a rearward and upward direction toward the supported breasts with the inflation of the inflatable portions in a forward direction away from the supported breasts being restricted.

31. A garment according to claim 30 in which at least a majority of each of the inflatable portions are located outwardly from the center of the supported breast.

32. A garment comprising:

first and second breast supporting cups; and means for selectively inflating at least a portion of the first and second breast supporting cups so as to provide a rearward and upward force against the supported breasts while restricting the expansion of the cups in a forward direction.

33. A method of supporting the breast of a garment wearer comprising:

inflating a bladder positioned in a garment to apply a rearward and upward force against the supported breasts; and restricting the freedom of the bladder to expand in a forward direction relative to the freedom of the bladder to expand in a rearward direction against the supported breast.

* * * * *